United States Patent [19]

Matta et al.

[11] 4,295,144

[45] Oct. 13, 1981

[54] FEED SYSTEM FOR A CIRCULARLY POLARIZED TETRA-COIL ANTENNA

[75] Inventors: Joseph J. Matta, Cinnaminson; Andrej Skalina, Cherry Hill, both of N.J.

[73] Assignee: RCA Corporation, New York, N.Y.

[21] Appl. No.: 136,155

[22] Filed: Mar. 31, 1980

[51] Int. Cl.[3] ..... H01Q 1/36

[52] U.S. Cl. ..... 343/895

[58] Field of Search ..... 343/885, 895, 908

[56] References Cited

U.S. PATENT DOCUMENTS 3,906,509 9/1975 DuHamel ..... 343/895

*Primary Examiner*—Eli Lieberman

*Attorney, Agent, or Firm*—Paul J. Rasmussen; William H. Meise; Henry I. Steckler

[57] ABSTRACT

A feed system for a helical CP antenna features folded belt or phasing lines to reduce space. This reduces icing and wind loading problems. If two belt lines are used, they can be placed diametrically opposite each other to reduce mutual coupling.

8 Claims, 6 Drawing Figures

FEED SYSTEM FOR A CIRCULARLY POLARIZED TETRA-COIL ANTENNA

BACKGROUND OF THE INVENTION

The present invention relates to feed systems for television broadcast antennas, and more particularly, for such feed systems when used with helical antennas for producing circular polarization.

Recently, there has been much interest in circular polarization for television broadcasting purposes in order to reduce ghosts in the displayed picture. One kind of antenna for producing circular polarization is shown in U.S. Pat. No. 3,940,772, which uses a plurality of helices wound around a conducting mast. Typically there are four such helices. A coaxial feed transmission line is disposed within the mast, and it must be coupled to the helices to excite them. Typically the coupling means comprises power splitters and transformers to achieve the necessary power division and phasing. Such devices are costly and complex, and further occupy a substantial space which adds to wind loading and icing problems.

It is therefore desirable to have a feed system for a plural coil helix antenna that is less expensive than the prior art, and which provides reduced wind loading and icing problems.

SUMMARY OF THE INVENTION

In brief, this is achieved by having a central conducting mast, at least first and second conducting helices disposed about said mast, a conductive housing disposed proximate one end of said helices, a coaxial transmission line disposed within said mast, the inner conductor of said line extending into said housing and being coupled to said first helix, and a first belt line disposed in said housing and coupled between said helices and having a selected length to provide a selected phase shift between said helices and being folded to conserve space.

DESCRIPTION OF THE DRAWINGS

FIG. 1A shows a side view partly in cross section of a first embodiment of the invention, while

FIG. 2A shows a side view partly in cross section of a second embodiment of the invention, while FIG. 3A shows a side view partly in cross section of a third embodiment of the invention, while

All of the above embodiments can be used with the antenna of said patent.

DETAILED DESCRIPTION

Figure 1A:
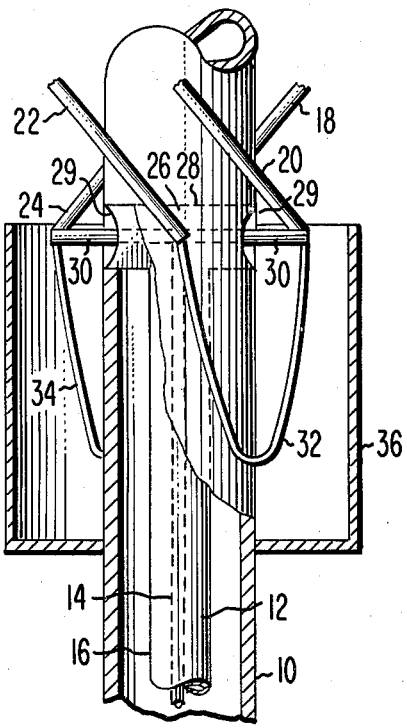
Figure 1B:
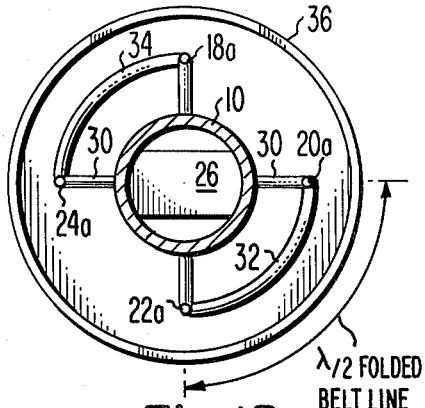
FIG. 1B shows a top view of only the feed system of the first embodiment without showing the helical antenna.

FIG. 1 shows a vertical electrically conducting hollow cylindrical mast 10. Disposed within the mast there is a coaxial transmission line 12 that conveys power from a transmitter (not shown) to the antenna. Line 12 has a characteristic impedance of 50 ohms and comprises an inner conductor 14 and an outer conductor 16. Uniformly disposed about the upper end of the mast 10 are four helices 18, 20, 22 and 24. These helices are each terminated at their upper end (not shown) by one end of radiating loads, the other end being R.F. coupled to the mast 10. These loads are matched to the characteristic impedance of the helices with respect to the mast 10, which is 200 ohms and thus only traveling waves can be excited on the helices. In order to excite the helices, the coaxial line 12 is coupled to the center of a T shaped coaxial section 26, the horizontally disposed portion of which has a characteristic impedance of 100 ohms and the vertical portion of which has a 50 ohm impedance. T section 26 has an outer conductor 28, which is electrically connected to the mast 10 at positions 29, and an inner conductor 30, which is isolated from mast 10 but which is coupled to and directly applies power to the lower ends 20*a* and 24*a* of helices 20 and 24 respectively. To provide the circularly polarized radiation pattern, circumferentially adjacent helices must be 180° out of phase at their lower ends. This is achieved through the use of half wave long belt lines 32 and 34. These belt lines 32 and 34 have a characteristic impedance of 200 ohms to match that of the helices 22 and 18 respectively at their lower ends 22*a* and 18*a* respectively. This impedance is determined by the spacing of lines 32 and 34 from mast 10 and shield 36. Shield 36 has a vertical height of one quarter wavelength to act as a choke to prevent unwanted currents from flowing along the mast 10. In order to keep the characteristic impedance of the belt lines constant, the belt lines 32 and 34 are made arcuate so as to maintain a constant spacing from the mast 10 and enclosure 36. In practice it has been found that deviations from being strictly arcuate are permissible, since, for example, a closer spacing to enclosure 36 necessarily results in a further spacing from mast 10 and thus the capacitance per unit length will remain substantially constant. The belt line 32 applies the 200 ohm characteristic impedance of helix 22 to helix 20. The two 200 ohm impedances combine in parallel to form a 100 ohm impedance to match the right hand section of the horizontal portion of the T section 26. The same holds true for belt line 34 with respect to helices 18 and 24 and the left hand section of T section 26. Within the T section 26, at its middle, the two 100 ohm impedances are coupled in parallel, and thus form a 50 ohm impedance to match the characteristic impedance of the vertical portion of T section 26 and coaxial line 12.

Figure 2A:
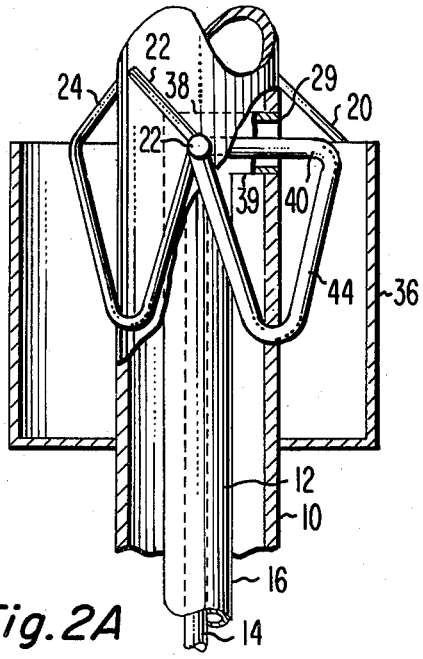
Figure 2B:
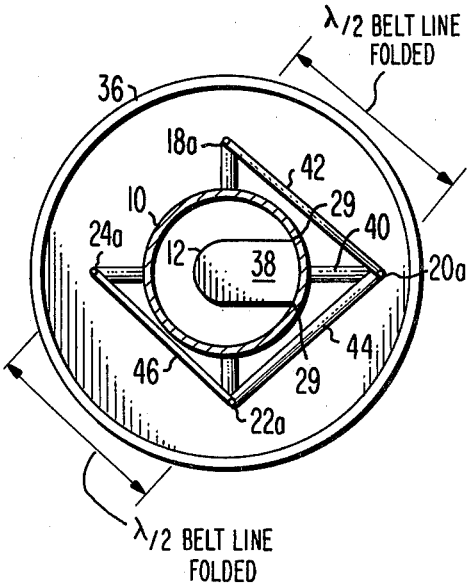
FIG. 2B shows a top view of only the feed system of said second embodiment without showing the helical antenna.

FIGS. 2A and 2B show a second embodiment of the invention, where corresponding elements have been given corresponding reference numerals. The top of the coaxial transmission line 12 is coupled to a right angle elbow section 38 having a 50 ohm characteristic impedance. Elbow 38 has an outer conductor 39 that connects to mast 10 at position 29, and an inner conductor 40 that projects out from the mast 10 to connect to the helix 20. All of the helices in this embodiment also have a characteristic impedance of 200 ohms. A belt line 42, which has a characteristic impedance of 200 ohms, and is one half of a wavelength long, connects the lower end 18*a* to the lower end 20*a*. It should be emphasized that the half wavelength electrical length results from the path length along folded conductor 42, and the distance between the lower ends 18*a* and 20*a* as shown in FIG. 2*b* is less than one half wavelength. The parallel combination of helix 20 and helix 18 has an impedance of 100 ohms. A half wave belt line 46 has a characteristic impedance of 200 ohms and connects the lower end 24*a* to the lower end 22*a*, and thus the resulting paralled combination has an impedance of 100 ohms. A half wave folded belt line 44 has a characteristic impedance of 100 ohms and thus applies a 100 ohm load to inner conductor 40. The parallel combination of this together with the 100 ohm load already existing on inner conductor 40 described above, results in a 50 ohm net load on inner conductor 40.

FIGS. 2A and 2B have the belt lines close together which makes achieving an exact electrical half wavelength difficult. Achieving this is necessary in order to achieve the right phasing between the helices.

Figure 3A:
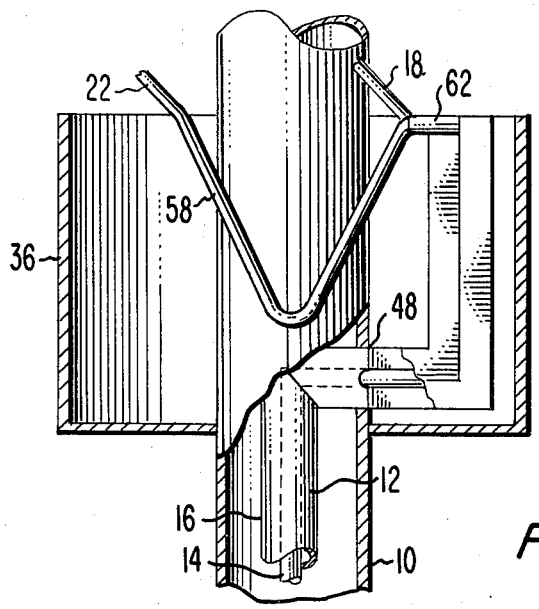
Figure 3B:
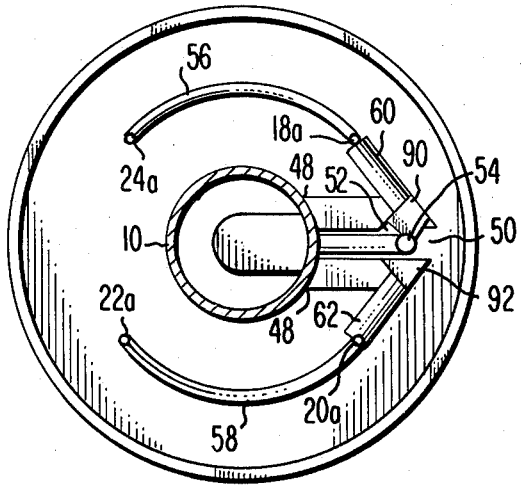
FIG. 3B shows a top view of only the feed system of said third embodiment without showing the helical antenna.

FIGS. 3A and 3B show a third embodiment of the invention which minimizes this problem. In this embodiment, the coaxial transmission line 12 makes a right angle turn through the wall of the mast 10 and outer conductor 16 contacts the mast 10 at position 48. The coaxial line 12 then makes another right angle bend and extends up and paralled the mast 10. The outer conductor 16 is slit for a distance of one quarter wavelength by slots 50 and 52 forming halves 90 and 92. The inner conductor 14 extends up between the slots 50 and 52 and is electrically connected to the outer conductor half 16*a* at point 54. It will be appreciated that a slotted balun is thereby formed which has a 4 to 1 impedance step-up ratio. Such baluns are known in the art and are more fully described in the book "Microwave Antenna Theory and Design", edited by Samuel Silver, Dover Publications, New York, Section 8.4, pages 245 to 248. In the embodiment of FIG. 3 the helices 18, 20, 22 and 24 also have a 200 ohm characteristic impedance, as do the half wave folded belt lines 56 and 58. Thus the impedance of helix 24 is presented as a 200 ohm impedance at the base of helix 18, and their parallel combination is 100 ohms. Similarly, the impedance of 22 is presented to the base of helix 20 as a 200 ohm impedance and their parallel combination is also 100 ohms. Belt line 60 has a characteristic impedance of 100 ohms and therefore applies a 100 impedance to balun half 90 and inner conductor 54. Belt line 62 is equal in length to belt line 60 for proper phasing and has a characteristic impedance of 100 ohms and therefore applies a 100 ohm impedance to balun half 92. These two impedances are in series and thus present an impedance of 200 ohms to the balun, and since the balun has a 4 to 1 impedance ratio, this impedance will match the 50 ohm characteristic impedance of the transmission line 12. It will be seen that this embodiment has low mutual coupling between the belt lines since they are diametrically disposed about mast 10. Further, the symmetry and larger spacing in FIG. 3 as compared to the other embodiments allows more independent adjustments of the phase and amplitudes of the various helices.

It will be apparent to those skilled in the art that other embodiments of the invention are possible. For example, more or less than four helices may be driven by such a folded feed structure. The feed coaxial line 16 may use as its outer conductor the inside of support mast 10, and its characteristic impedance may be adjusted to suit the terminating impedances. The feed structure may drive the helices from their upper ends rather than from their lower ends. Capacitive adjustment of the impedance of the folded belt line may be made by means of capacitive probes penetrating cage 36 into proximity of the belt line, or vice versa. A radome is normally used over enclosure 36 to prevent precipitation from entering. Two baluns can also be used with a T section feed.

What is claimed is:

1. An antenna comprising a central conductive mast, at least first and second conducting helices disposed about said mast, a conductive housing disposed proximate an end of said helices, a coaxial transmission line disposed within said mast, the inner conductor of said line extending into said housing and being coupled to said first helix, and a first belt line disposed in said housing and coupled between said helices and having a selected length to provide a selected phase shift between said helices and being folded to conserve space.

2. An antenna as claimed in claim 1, further comprising third and fourth conducting helices disposed about said mast, said inner conductor being coupled to all of said helices.

3. An antenna as claimed in claim 2, further comprising a second belt line disposed in said housing and coupled between said third and fourth helices to provide a selected phase shift therebetween, said second belt line being folded to conserve space.

4. An antenna as claimed in claim 3, wherein said first and third helices are adjacent each other, and further comprising a balun coupled between said transmission line and said first and third helices.

5. An antenna as claimed in claim 3, wherein said first and third helices are opposite each other.

6. An antenna as claimed in claim 2, further comprising second and third belt lines disposed in said housing and coupled between said first and third and said third and fourth helices respectively for providing selected phase shifts therebetween respectively, said belt lines being folded to conserve space.

7. An antenna as claimed in claims 1 or 3, wherein said housing is circular and said belt lines are arcuate and evenly spaced from said housing to provide a constant characteristic impedance along the length of any belt line.

8. An antenna as claimed in claim 1, wherein said first belt line lies in a cylindrical surface coaxial with said mast.

* * * * *